US011167886B1

(12) United States Patent
Schuster et al.

(10) Patent No.: US 11,167,886 B1
(45) Date of Patent: Nov. 9, 2021

(54) BUCKET ATTACHMENT

(71) Applicant: Danco, Inc., Irving, TX (US)

(72) Inventors: Michael J. Schuster, Shorewood, IL (US); Thomas R. Bajek, Naperville, IL (US); Dwayne A. Porter, Lockport, IL (US)

(73) Assignee: Danco, Inc., Irving, TX (US)

( * ) Notice: Subject to any disclaimer, the term of this patent is extended or adjusted under 35 U.S.C. 154(b) by 0 days.

(21) Appl. No.: 16/843,224

(22) Filed: Apr. 8, 2020

Related U.S. Application Data

(60) Provisional application No. 62/832,949, filed on Apr. 12, 2019.

(51) Int. Cl.
*B65D 25/20* (2006.01)
*B65F 1/10* (2006.01)
*A47L 13/52* (2006.01)

(52) U.S. Cl.
CPC ..... *B65D 25/20* (2013.01); *A47L 13/52* (2013.01); *B65F 1/10* (2013.01); *B65F 2210/136* (2013.01)

(58) Field of Classification Search
CPC . B65D 25/20; A47L 13/52; B65F 1/10; B65F 2210/136
USPC ..... 220/694, 629, 700, 701, 733
See application file for complete search history.

(56) References Cited

U.S. PATENT DOCUMENTS 4,312,531 A * 1/1982 Cross ..... E01H 1/12 141/108
4,802,258 A * 2/1989 Jensen ..... A47L 13/52 141/108
D439,718 S * 3/2001 Thorpe ..... D34/28
6,915,921 B2 * 7/2005 Mensch ..... B65F 1/14 15/257.5
10,029,849 B1 * 7/2018 Genotti, III ..... B65B 67/04
2005/0056649 A1 * 3/2005 Simonson ..... B65F 1/06 220/495.08
2011/0283474 A1 * 11/2011 McCoy ..... A47L 13/52 15/257.1
2016/0037994 A1 * 2/2016 Wollman ..... A47L 13/52 15/257.7
2018/0042445 A1 * 2/2018 Carcioppolo ..... B65F 1/10
2018/0057258 A1 * 3/2018 Dervin ..... B65F 1/10

* cited by examiner

*Primary Examiner* — J. Gregory Pickett
*Assistant Examiner* — Niki M Eloshway
(74) *Attorney, Agent, or Firm* — Thomas | Horstemeyer LLP

(57) ABSTRACT

A cleaning attachment for a utility bucket is disclosed. One embodiment, among others, the cleaning attachment includes a ramp with a first end and a second end. The second end may have a greater height than the first end. The cleaning attachment also includes a back platform and a rim engagement slot. The back platform may have a smaller height than the second end of the ramp. The rim engagement slot can be configured to engaging a rim of the utility bucket. The rim engagement slot can formed between a back wall of the second end of the ramp and the back platform.

21 Claims, 8 Drawing Sheets

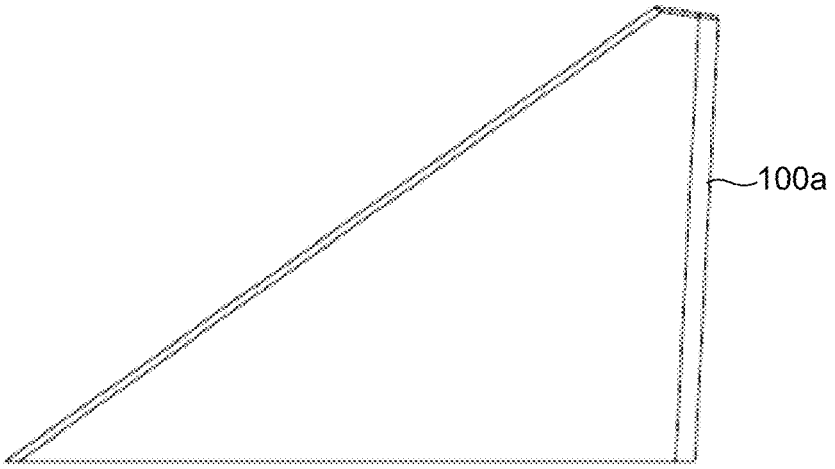
FIG. 5A
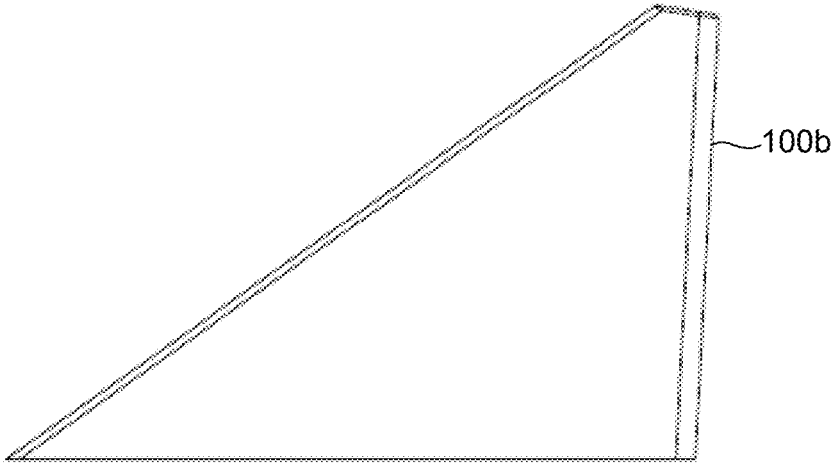
FIG. 5B
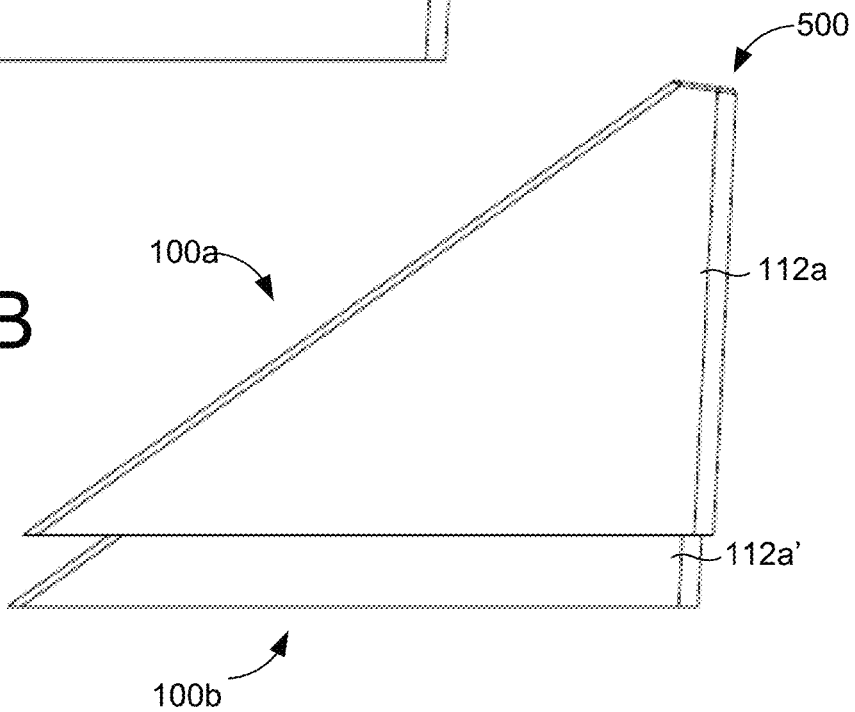

BUCKET ATTACHMENT

CROSS REFERENCE TO RELATED APPLICATIONS

This application claims priority to and the benefit of U.S. Patent Application No. 62/832,949, entitled "Bucket Attachment, filed on Apr. 12, 2019, the entire contents of which are hereby incorporated herein by reference.

BACKGROUND

Utility buckets are commonly found at job sites, in garages, in warehouse facilities, and in many other areas. These buckets are used for a variety of purposes, such as for storing or transporting items. Because of their widespread availability, buckets may even be used as a dustpan when a typical dustpan or trash can is not available.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 5A and 5B illustrate an exemplary progression of nesting multiple cleaning attachments, according to one embodiment described herein.

DETAILED DESCRIPTION

The embodiments of the present disclosure relate to a cleaning attachment for a utility bucket. Utility buckets are commonly found at job sites, in garages, in warehouse facilities, and in many other areas. These buckets are used for a variety of purposes, such as for storing or transporting items. For example, a five gallon bucket may be used to store paint or other liquids. Because of their widespread availability, empty buckets can be placed on their side and used as a dustpan when a typical dustpan or trash can is not available. When used as a dustpan on its side, the bucket has limited usefulness because of the circular shape of the bucket. A bucket may be difficult to keep steady on its side while attempting to push or sweep debris into its opening. Debris may also be difficult to push or sweep into the bucket because it may be difficult to push debris over the rim of the bucket.

The cleaning attachment of the present disclosure includes structural components that enable for a ramp to attach to a commonly available bucket. The various embodiments of the cleaning attachment can stabilize the bucket as debris is swept into the bucket. The embodiments also enable for multiple cleaning attachments to nest within each other to occupy less space than a stacked arrangement of multiple cleaning attachments.

Figure 1A:
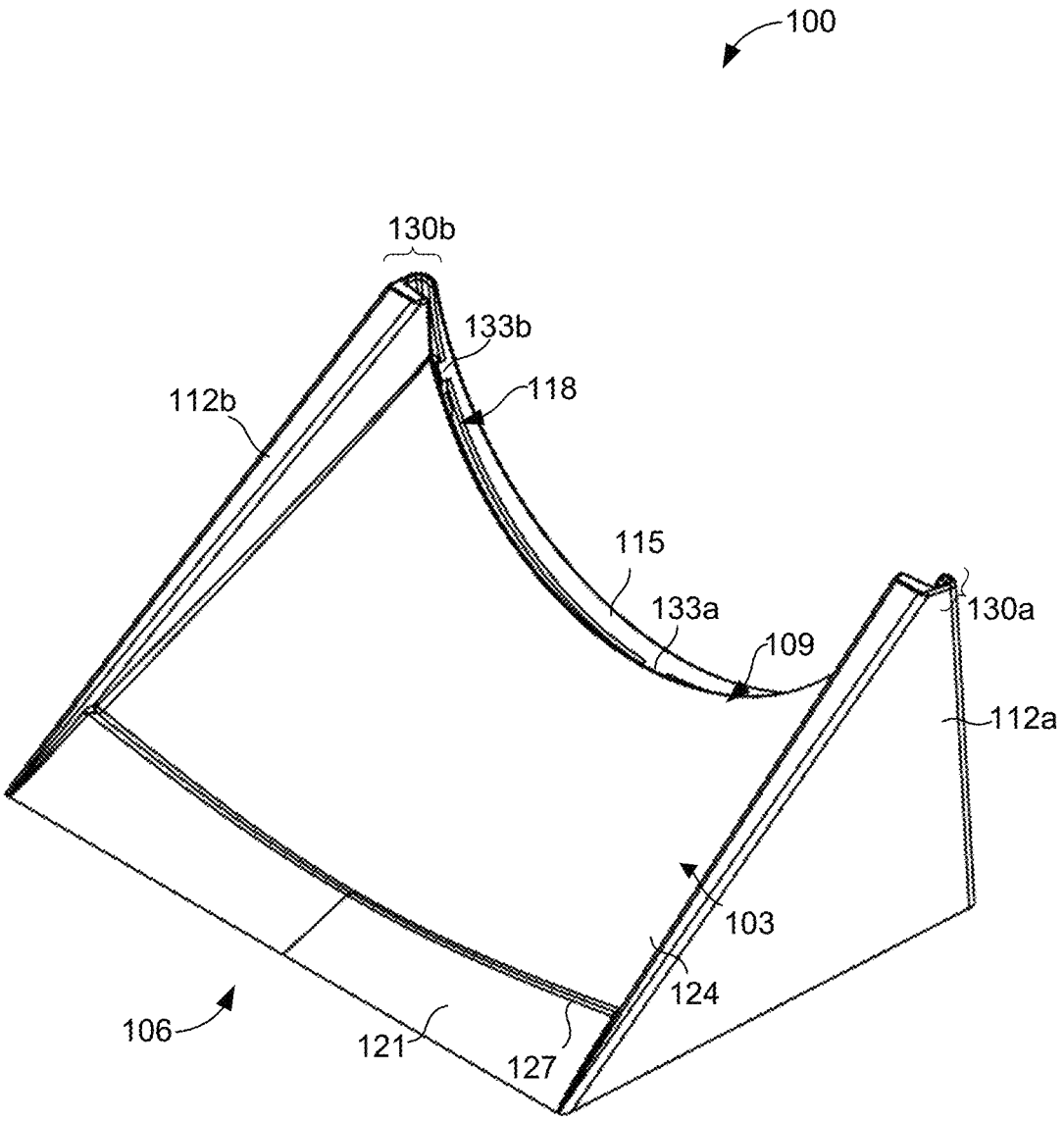
FIG. 1A illustrates a front perspective view of a cleaning attachment, according to one embodiment described herein.

FIG. 1A provides a perspective view of a cleaning attachment 100 that can be attached to a utility bucket. The cleaning attachment 100 includes a ramp 103 with a first end 106 and a second end 109. The ramp 103 can be attached to a first side wall 112*a* and a second side wall 112*b* (collectively the "side walls 112"). The cleaning attachment 100 also includes a back platform 115 and a rim engagement slot 118. The rim engagement slot 118 can be formed between a portion of the second end 109 of the ramp 103 and the back platform 115.

The ramp 103 provides an inclined surface from a floor to an opening of the utility bucket. The ramp 103 includes a front portion 121 and a rear portion 124 that may be connected by a recessed area 127. As illustrated, the front portion 121 may be substantially flat and inclined. The rear portion 124 of the ramp 103 can have a curved surface. For example, FIG. 1A illustrates a non-limiting example of the rear portion 124 having a concave surface. As illustrated in FIG. 1A, the curvature of the rear portion 124 increases at areas that are closer to the second end 109. At the second end 109, the curvature of the ramp 103 can correspond to a perimeter of a rim of a utility bucket. In some embodiments, the entire ramp 103, the front portion 121 and the rear portion 124, may be substantially flat and inclined. Accordingly, the ramp 103 can support buckets with a variety of different perimeter shapes in addition to a circular shaped perimeter of typical buckets. For example, the ramp 103 can support buckets with a square-shape, a rectangular shape, or other suitable shaped perimeter.

The side walls 112 can be attached to the ramp 103 along its length. The side walls 112 can also form a portion of the first side end 130*a* and a second side end 130*b* (collectively the "side ends 130") of the rim engagement slot 118. Although the side ends 130 are elevated to support a circular bucket, the side ends 130 may extend horizontally from a substantially straight rim engagement slot 118 in order to support buckets with straight sides, such as square-shaped bucket.

The back platform 115 can be used to support a portion of a utility bucket below its rim. The back platform 115 can be recessed and have a height that is less than a height of the second end 109 of the ramp 103. Since the back platform 115 can have a lower height than parts of the second end 109 of the ramp 103, a portion of the utility bucket can be placed on the back platform 115 to enable the opening of the utility back to substantially align with the second end 109 of the ramp 103.

The back platform 115 may also include a first engagement tab 133*a*, a second engagement tab 133*b*, and a third engagement tab 133*c* (FIG. 2) (collectively the "engagement tabs 133"). The engagement tabs 133 can be used to restrain a rim of a utility bucket when the rim is positioned in the rim engagement slot 118. Particularly, the engagement tabs 133 can be positioned within a cavity behind the rim of the utility bucket, which can at least partially restrain the rim of the utility bucket when the rim of the bucket is moved at certain angles from the rim engagement slot 118.

The rim engagement slot 118 can be formed between a portion of the second end 109 of the ramp and the back platform 115. The rim engagement slot 118 can be used to position a rim of a utility bucket. While the rim of the utility bucket is positioned in the rim engagement slot 118, a portion of an exterior surface of the utility bucket can be positioned on the back platform 115. The rim engagement slot 118 can have a curved shape between a first side end 130*a* and a second side end 130*b*. In other embodiments, the rim engagement slot 118 may have a substantially straight or horizontal shape in order to accommodate bucket with sides, such as a square-shape, a rectangular-shaped bucket, or other suitable bucket shapes.

Figure 1B:
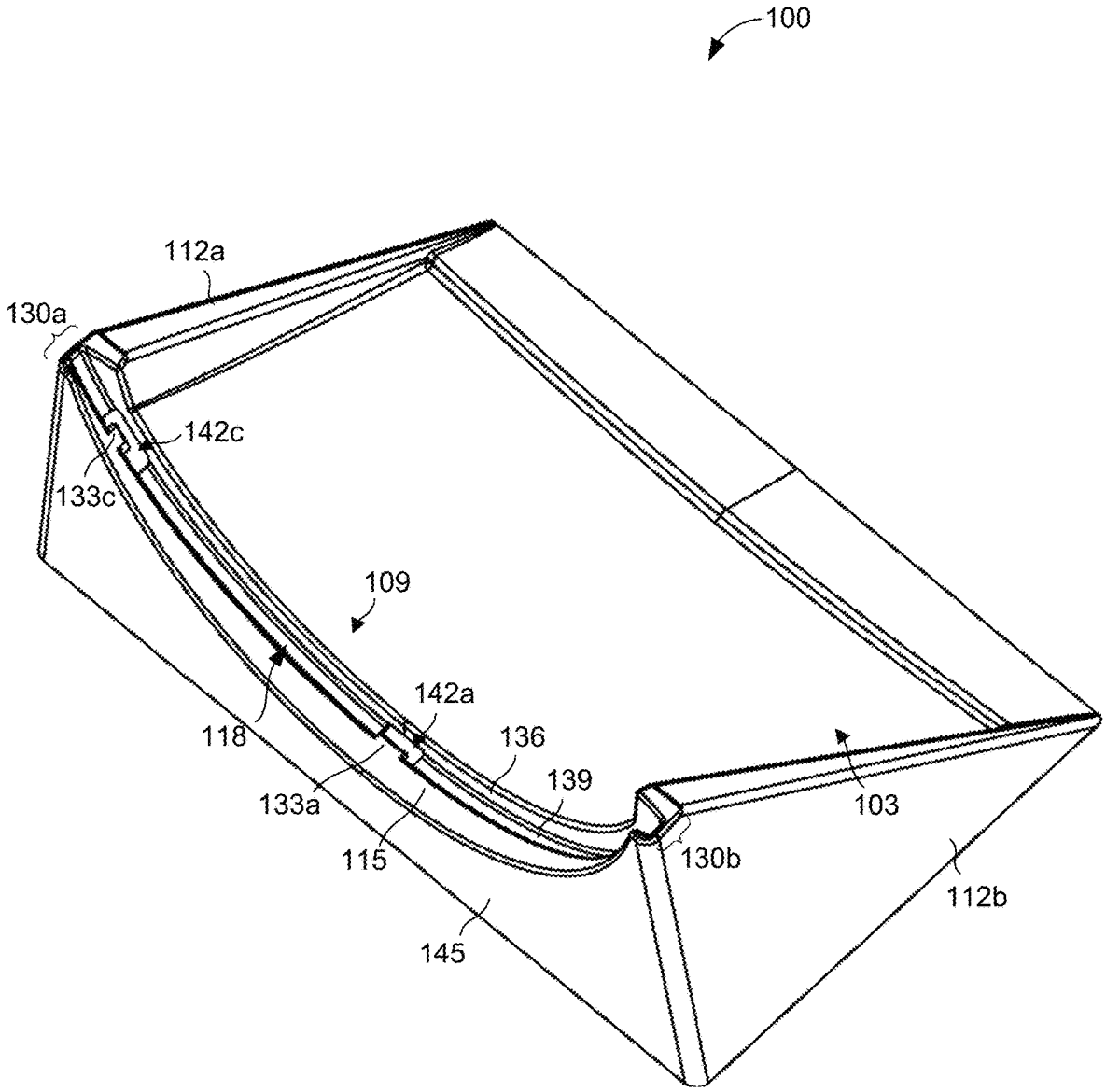
FIG. 1B illustrates a rear perspective view of the cleaning attachment from FIG. 1A, according to one embodiment described herein.

Moving on FIG. 1B, shown is a perspective rear view of the cleaning attachment 100 from FIG. 1A. FIG. 1B illustrates an alternative view of the rim engagement slot 118. As illustrated in FIG. 1B, the rim engagement slot 118 is formed between a back wall 136 of the second end 109 of the ramp 103. The back wall 136 extends from the second end 109 of the ramp 103. Portions of the back wall 136 can be formed from the side walls 112. FIG. 1B illustrates that the back wall 126 curves to correspond to the second end 109 of the ramp 103.

The rim engagement slot 118 also includes a bottom surface 139 that extends from the back wall 136. The bottom surface 139 curves along the length of the rim engagement slot 118. When attached, a portion of the rim of the utility bucket can be positioned on the bottom surface 139 of the rim engagement slot 118. Additionally, the bottom surface 139 includes a first tab opening 142*a*, a second tab opening 142*b* (FIG. 2), and a third tab opening 142*c* (collectively the "tab openings 142"). The tab openings 142 can align with the engagement tabs 133. The tab openings 142 can have a width "W" (FIG. 2) that is greater than a width of the engagement tabs 133. In some embodiments, the tab openings 142 are created in order to provide access for a molding tool to form the engagement tabs 133. The back platform 115 also includes a rear wall 145 that extends from its curved edge. Not be limited to the engagement tabs 133 as other methods of attachments or detents as can be appreciated.

Figure 2:
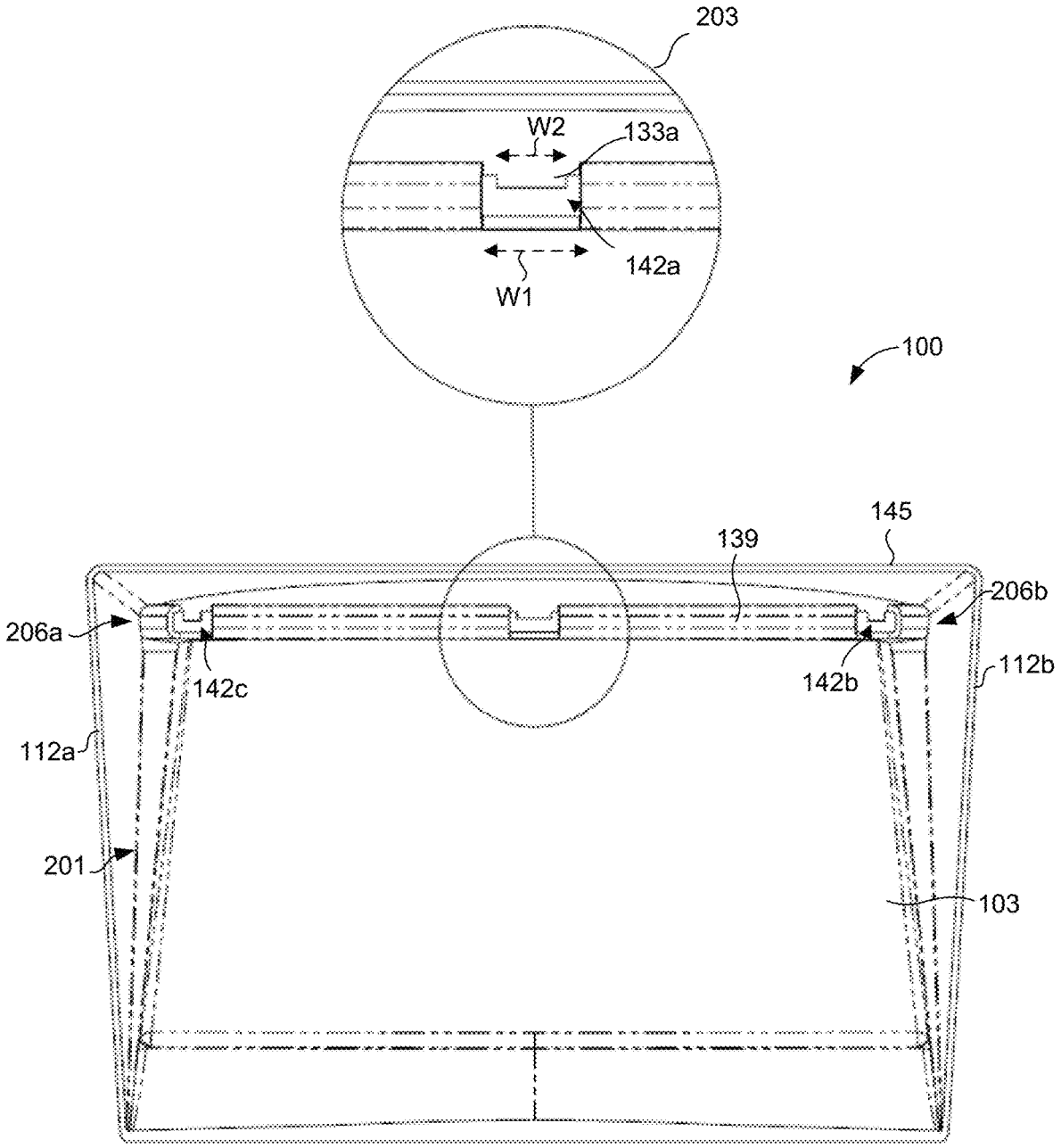
FIG. 2 illustrates a bottom view of the cleaning attachment from FIG. 1A, according to one embodiment described herein.

With reference to FIG. 2, shown is a bottom view of the cleaning attachment 100 from FIGS. 1A and 1B. FIG. 2 illustrates a recessed underside 201 of the cleaning attachment 100. In some non-limiting examples, the recessed underside 201 can be formed from the side walls 112, the ramp 103, the rim engagement slot 129, and the rear wall 145. The recessed underside 201 includes numerous cavities formed from the exterior surface of various components on the underside of the cleaning attachment 100. The recessed underside 201 can include a first side cavity 206*a* and a second side cavity 206*b* (collectively the "side cavities 206"). The side cavities 206 can be formed by the side walls 112, the rear wall 145, portions of the underside of the rim engagement slot 118, portions of the underside of the ramp 103, and/or other suitable components of the cleaning attachment 100. The recessed underside 201 can be used to form a nesting arrangement 500 (FIG. 5B) of multiple cleaning attachments 100. For example, the side ends 130 (FIG. 1B) of a first cleaning attachment 100 can be inserted into the side cavities 206 of a second cleaning attachment 100. By inserting portions of a first cleaning attachment 100 into a second cleaning attachment 100, the multiple cleaning attachments 100 can reduce the amount of space occupied by the multiple cleaning attachments 100.

Reference 203 refers to an enlarged view of the underside of the first engagement tab 133*a*, the first tab opening 142*a*, and a portion of the rim engagement slot 118. The enlarged view 203 illustrates that the width "W1" of the first tab opening 142*a* is greater than the width "W2" of the first engagement tab 133*a*. During a molding process, a component of a molding tool may enter through the first tab opening 142*a* from underneath the cleaning attachment 100 to form the first engagement tab 133*a*.

Figure 3A:
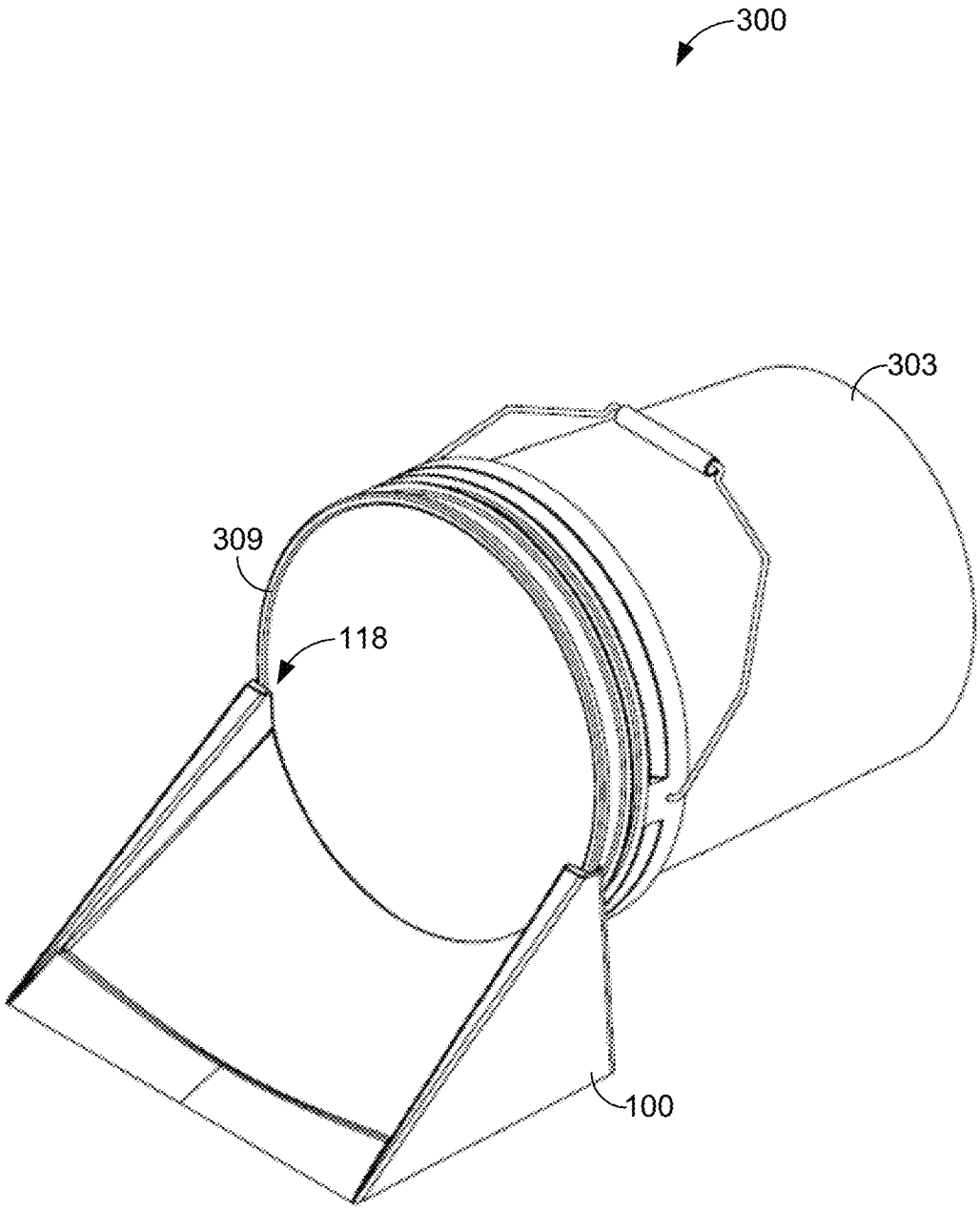
FIG. 3A illustrates a perspective view of a cleaning attachment attached to a utility bucket, according to one embodiment described herein.
Figure 3B:
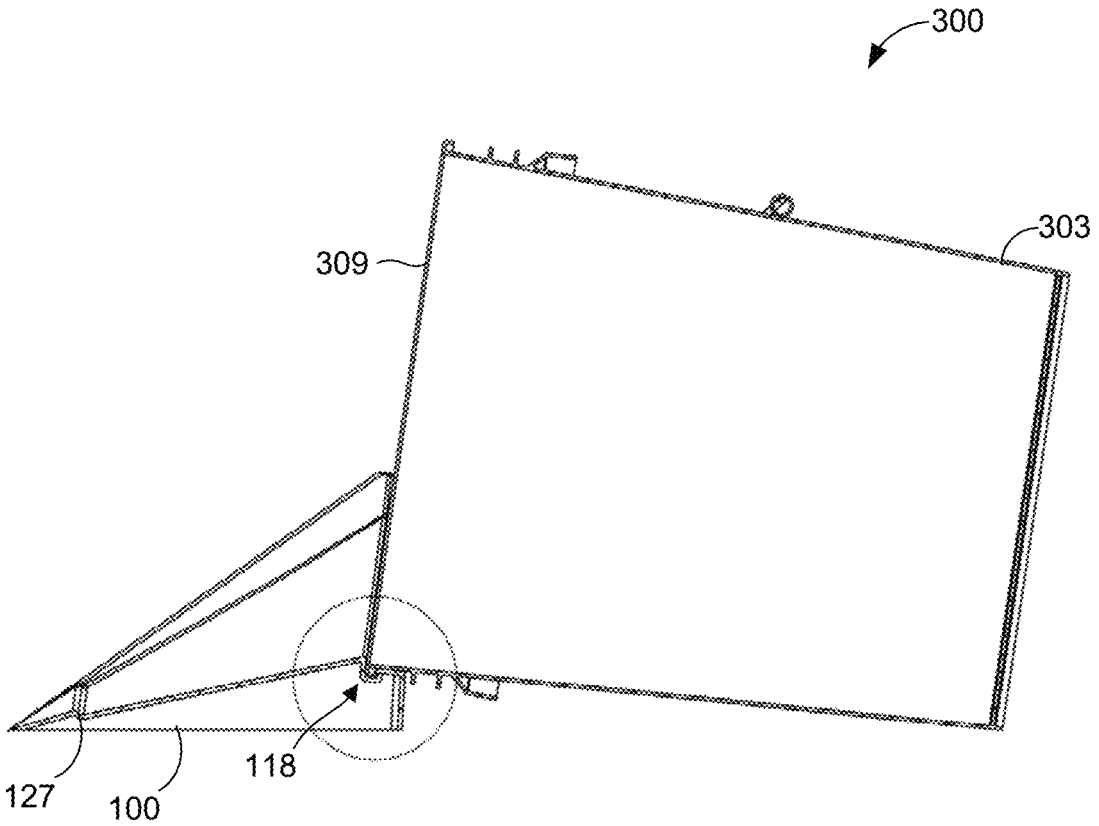
FIGS. 3B and 3C illustrate different cross-sectional views of the cleaning attachment attached to the utility bucket from FIG. 3A, according to one embodiment described herein.
Figure 3B:
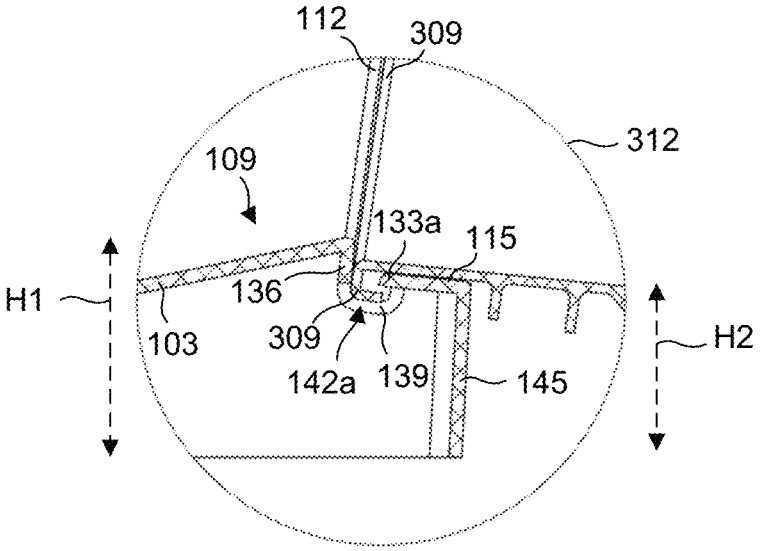

With reference to FIG. 3A, shown is a perspective view of an assembly 300 of the cleaning attachment 100 coupled to a utility bucket 303. As illustrated in FIG. 3A, a rim 309 of the utility bucket 303 is positioned within the rim engagement slot 118. Next, FIG. 3B illustrates a first cross-sectional view of the assembly 300 in FIG. 3A. Particularly, FIG. 3B illustrates a first cross-sectional view of the assembly 300 through the first engagement tab 133*a* and the first tab opening 142*a*. FIG. 3B also includes an enlarged view 312 of the interaction between the rim 309 of the utility bucket 303 within the rim engagement slot 118.

With regard to FIG. 3B, the enlarged view 312 illustrates additional structure aspects of the cleaning attachment 100. For instance, the enlarged view 312 illustrates that the second end 109 of the ramp 103 has a height "H1" and that the back platform 115 has a height "H2" substantially near the first engagement tab 133*a*. In this illustrated example, height "H2" is less than height "H1." With height "H2" less than height "H1," the utility bucket 303 can be tilted or angled on the back platform. Also, a bottom portion of the opening of the utility bucket 303 can be lowered the highest part of the second end 109 of the ramp 103. As a result, as debris is pushed into the utility bucket 303, it can fall off of the ramp 103 and into the utility bucket 303. The back platform 115 can have a sloped top surface that declines from the rim engagement slot 118 toward the rear wall 145. The declining top surface of the back platform 115 enables the utility bucket 303 to be elevated and tilted.

FIG. 3B illustrates is an open space between the back wall 136 and the first engagement tab 133*a* which represents the first tab opening 142*a*. The far side of the first tab opening 142*a* is the bottom surface 139 of the rim engagement slot 118. The bottom surface 139 also can have a sloped surface which declines from the back wall 136 toward the rear wall 145. The declining bottom surface 139 can support tilting the rim 309 of the utility bucket 303. In some embodiments, portions of the bottom surface 139 can have a parallel declining slope as the top surface of the back platform 115. The side walls 112 can also be positioned adjacent to the rim 309 of the utility bucket 303. Additionally, the side walls 112 can be angled to correspond with the angle of the rim 309 of the utility bucket 303.

With respect to attaching to the cleaning attachment 100, in one non-limiting example, the rim 309 of the utility bucket 303 can be oriented downward toward the rim engagement slot 118. The rim 309 can be inserted in the rim engagement slot 118 such that the engagement tabs 133 are positioned within the cavity behind the rim 309 of the utility bucket 303, as illustrated in enlarged view 312. In some cases, the rim 309 can be inserted into the rim engagement slot 118 and pivoted around the engagement tabs 133. In some scenarios, the tip of the rim 309 may be positioned on the bottom surface 139 of the rim engagement slot 118 and then moved toward the back platform 115 in order to position a portion of the rim 309 underneath the engagement tab 133.

At this stage, the rim 309 may be laying on the bottom surface 139 and areas below the rim 309 of the utility bucket 303 can be in contact with the back platform 115. The engagement tabs 133 can keep the rim 309 of the utility bucket 303 to stay within the rim engagement slot 118 because the engagement tabs 133 can block the rim 309 being lifted directly up and at some other angles. The tilt of the bottom surface 139 of the rim engagement slot 118 and the top surface of the back platform 115 supports a tilt of the utility bucket 303. As debris is swept up the ramp 103 and into the utility bucket 303, the tilt or elevated portion of the rim 309 can enable the debris to move to the back of the utility bucket 303 and stay within the utility bucket 303.

Figure 3C:
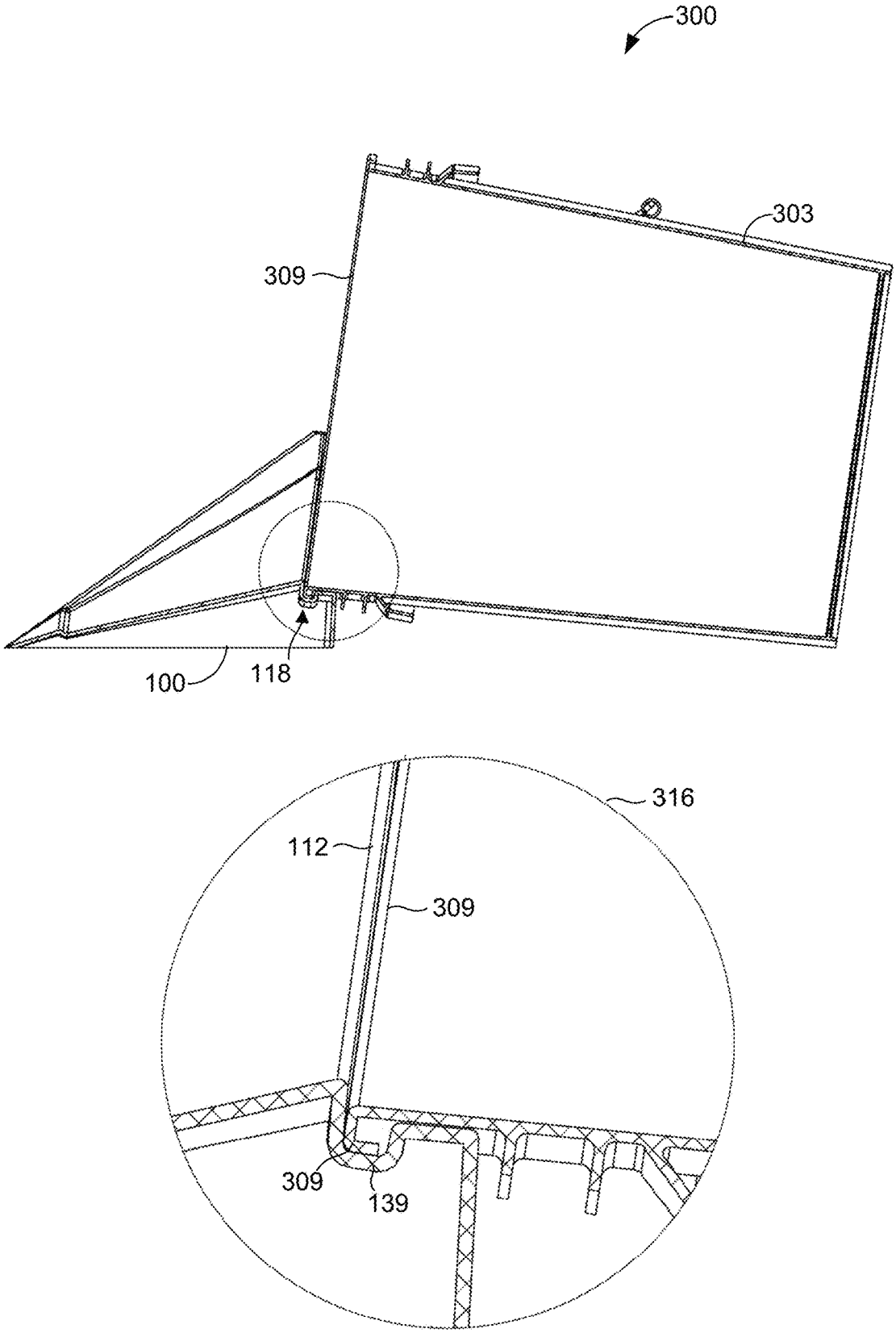

FIG. 3C illustrates another cross-sectional view of the assembly 300 from FIG. 3A. FIG. 3C also includes an enlarged view 316 of the rim 309 of the utility bucket 303 positioned in the rim engagement slot 118. In FIG. 3C, the rim 309 of the utility bucket 303 is position adjacent to a rear edge of the side wall 112.

The enlarged view 316 also illustrates a cross-sectional view of the rim engagement slot 118 that does not intersect with one of the engagement tabs 133 (FIG. 3B) and the tab openings 142 (FIG. 3B). In some non-limiting examples, FIG. 3C can represent a cleaning attachment 100 in which the engagement tabs 133 and the tab openings 142 are omitted. The rim 309 of the utility bucket 303 can be placed into the rim engagement slot 118 directly without having to pivot the rim 309 of the utility bucket 303 around the engagement tabs 133.

Figure 4A:
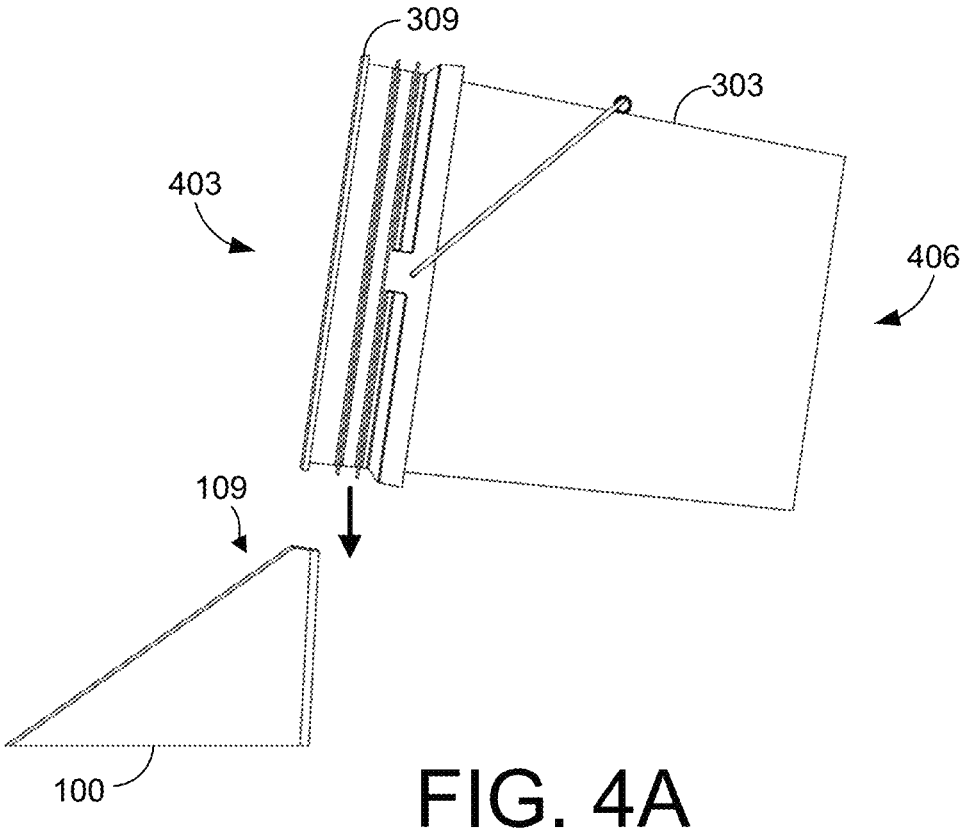
FIGS. 4A and 4B illustrate an exemplary progression of attaching the cleaning attachment onto a utility bucket, according to one embodiment described herein.
Figure 4B:
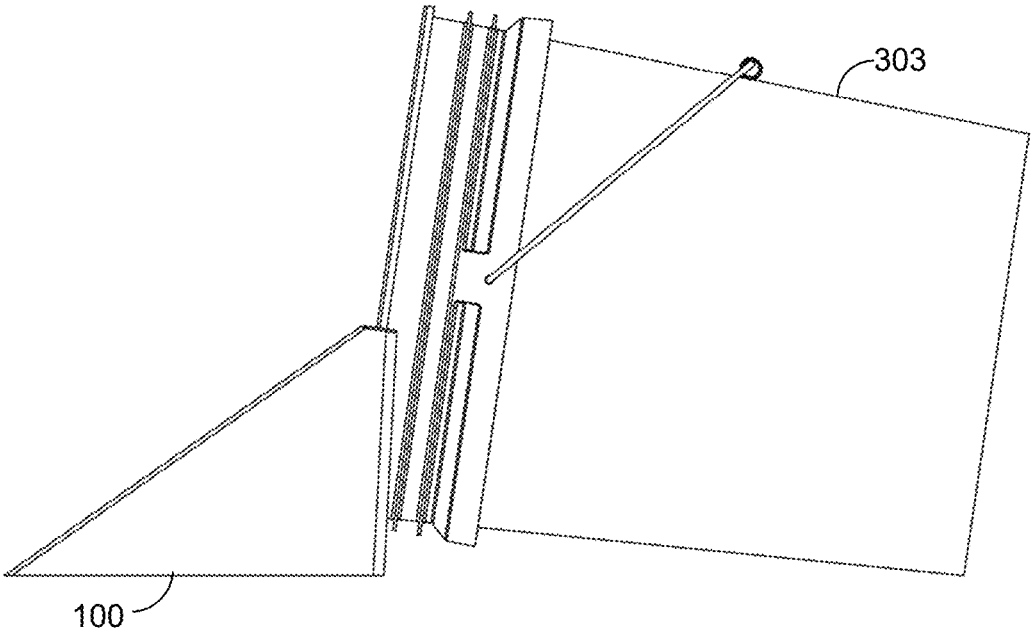

With reference to FIGS. 4A and 4B, shown are different side views of a progression for attaching the utility bucket 303 to the cleaning attachment 100. FIG. 4A illustrates a side view of the cleaning attachment 100 positioned below the utility bucket 303 and prior to being attached to the utility bucket 303. FIG. 4A illustrates that the utility bucket 303 is positioned near the second end 109 of the ramp and tilted at an angle such that the utility bucket 303 the rim 309 is elevated higher than the bottom end 406 of the utility bucket 303. In this orientation, the utility bucket 303 can be moved downward toward the cleaning attachment 100 for positioning the rim 309 in the rim engagement slot 118 and pivoting the rim 309 around the engagement tabs 133 of the cleaning attachment 100. FIG. 4B illustrates the cleaning attachment 100 attached to the utility bucket 303. Upon being attached, debris can be swept up the ramp 103 (FIG. 1A) and into the utility bucket 303.

With reference to FIGS. 5A and 5B, shown are various views of two cleaning attachments 100 first positioned separately and then positioned in a nested arrangement 500. FIG. 5A illustrates a first cleaning attachment 100*a* positioned above a second cleaning attachment 100*b*. FIG. 5B illustrates the second cleaning attachment 100*b* nested within the first cleaning attachment 100*a* to form the nested arrangement 500. The nested arrangement 500 can be formed by positioning the first cleaning attachment 100*a* above the second cleaning attachment 100*b*. The first side end 130*a* (FIG. 1A) of the second cleaning attachment 100*b* can be aligned with a first side cavity 206*a* (FIG. 2) of the first cleaning attachment 100*a*. The second side end 130*b* (FIG. 1A) of the second cleaning attachment 100*b* can be aligned with a second side cavity 206*b* (FIG. 2) of the first cleaning attachment 100*a*. The second cleaning attachment 100*b* can be inserted toward the underside 201 (FIG. 2) of the first cleaning attachment 100*a*. As illustrated in FIG. 5B, the side walls 112 of the first cleaning attachment 100*a* encompass the side walls 112*a*' of the second cleaning attachment 100*b* in the nested arrangement 500. Accordingly, the illustrated nested arrangement 500 occupies less space than the two cleaning attachments 100 stacked on top of each other. It should be noted that nesting can refer to a portion of a second cleaning attachment 100*b* positioned within a first cleaning attachment 100*a*. Additionally the nesting feature helps lower the packaging cost (fit more in each box) and reduces shipping costs.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An attachment apparatus for a utility bucket, comprising:

a ramp with a first end and a second end, the second end comprising a concave surface and having a greater height than the first end;

a back platform that has a smaller height than the second end of the ramp; and a rim engagement slot for engaging a rim of a utility bucket, the rim engagement slot being formed between a back wall of the second end of the ramp and the back platform, wherein the rim engagement slot has an opening between the back wall and the back platform that is accessible by lowering the rim of the utility bucket from above the attachment apparatus into the rim engagement slot.

2. The attachment apparatus of claim 1, wherein the back platform comprises a rim engagement tab that extends from the back platform and over a portion of the rim engagement slot.

3. The attachment apparatus of claim 2, wherein the rim engagement slot has a bottom surface comprising an opening with a greater width than the rim engagement tab.

4. The attachment apparatus of claim 3, wherein the opening in the bottom surface of the rim engagement slot aligns with a positioning of the rim engagement tab.

5. The attachment apparatus of claim 1, wherein the back platform comprises a top surface that declines away from the rim engagement slot, wherein a lower end of the back platform extends from a rear wall.

6. The attachment apparatus of claim 1, wherein the rim engagement slot comprises a bottom surface that declines toward the back platform, wherein a higher end of the bottom surface extends from the back wall of the second end of the ramp.

7. The attachment apparatus of claim 1, wherein a top surface of the back platform corresponds to a curve of the second end of the ramp.

8. The attachment apparatus of claim 1, further comprising a side wall that extends from the ramp, wherein the side wall forms a portion of the concave surface of the second end of the ramp.

9. The attachment apparatus of claim 8, wherein a portion of the side wall forms a portion of the back wall of the ramp.

10. The attachment apparatus of claim 1, wherein the back platform is configured to support a portion of a side of the utility bucket below the rim of the utility bucket.

11. The attachment apparatus of claim 1, wherein the rim of the utility bucket can be positioned on a bottom surface of the rim engagement slot.

12. An apparatus that is attachable to a utility bucket, the apparatus comprising:

a ramp comprising a first end and a second end;

a back wall extending from the second end of the ramp;

a back platform that has a smaller height than the second end of the ramp; and a rim engagement slot for engaging a rim of a utility bucket, the rim engagement slot being formed between the back wall of the second end of the ramp and the back platform, wherein the rim engagement slot has an opening between the back wall and the back platform that is accessible by lowering the rim of the utility bucket from above the apparatus into the rim engagement slot.

13. The apparatus of claim 12, wherein the back platform comprises a rim engagement tab that extends from the back platform over a portion of the rim engagement slot.

14. The apparatus of claim 13, wherein a bottom surface of the rim engagement slot of comprises an opening with a greater width than the rim engagement tab.

15. The apparatus of claim 12, wherein the back platform comprises a top surface that declines away from the rim engagement slot.

16. The apparatus of claim 12, further comprises a side wall that forms a portion of the back wall.

17. The apparatus of claim 12, wherein a portion of the second end of the ramp has a greater height than the back platform.

18. The apparatus of claim 12, wherein a top surface of the back platform is curved to correspond to the rim engagement slot.

19. The apparatus of claim 12, wherein the rim engagement slot comprises a bottom surface that declines toward the back platform.

20. The apparatus of claim 12, further comprising:

a side cavity formed underneath the apparatus, the side cavity formed from a rear wall, a side wall, and a portion of the rim engagement slot, the side cavity being configured to nest a portion of another apparatus.

21. A method for attaching a cleaning attachment to a bucket, comprising:

positioning a rim of a utility bucket at an angle with respect to a rim engagement slot of a cleaning attachment, the rim engagement slot being formed between a back wall of a ramp and a back platform;

lowering the rim of the utility bucket from above the cleaning attachment into the rim engagement slot; and pivoting the rim of the utility bucket around an engagement tab extending from the back platform of the cleaning attachment.

* * * * *